US005660231A

United States Patent [19]

Belonenko

[11] Patent Number: 5,660,231

[45] Date of Patent: Aug. 26, 1997

[54] METHOD OF PRODUCING HYDROCARBONS FROM SUBTERRANEAN FORMATIONS

[75] Inventor: Vladimir Nikolaevich Belonenko, Moskovskaya obl., Russian Federation

[73] Assignee: Aktsionernoe Obschestvo Zakrytogo Tipa "Biotekinvest", Moscow, Russian Federation

[21] Appl. No.: 394,180

[22] Filed: Feb. 24, 1995

Related U.S. Application Data

[63] Continuation of PCT/RU94/00136, Jun. 24, 1994.

[30] Foreign Application Priority Data

| | | | |
|---|---|---|---|
| Jun. 25, 1993 | [RU] | Russian Federation | 93033278 |
| Jun. 25, 1993 | [RU] | Russian Federation | 93033279 |
| Jun. 25, 1993 | [RU] | Russian Federation | 93033280 |

[51] Int. Cl.[6] ..... E21B 43/25

[52] U.S. Cl. ..... 166/249

[58] Field of Search ..... 166/249, 177, 166/299, 65.1, 63, 302, 303, 256

[56] References Cited

U.S. PATENT DOCUMENTS

| | | | |
|---|---|---|---|
| 2,670,801 | 3/1954 | Sherborne | 166/249 |
| 3,794,114 | 2/1974 | Brandon | 166/249 |
| 4,345,650 | 8/1982 | Wesley | 166/249 |
| 4,417,621 | 11/1983 | Medlin et al. | 166/249 |
| 4,679,627 | 7/1987 | Harrison | 166/249 |
| 4,945,986 | 8/1990 | Hardin et al. | 166/249 |
| 5,396,955 | 3/1995 | Howlett | 166/249 |

FOREIGN PATENT DOCUMENTS

| | | |
|---|---|---|
| 1838594 | 8/1993 | Russian Federation . |
| 1596081 | 10/1990 | U.S.S.R. . |
| 1677272 | 9/1991 | U.S.S.R. . |
| 1694872 | 11/1991 | U.S.S.R. . |

OTHER PUBLICATIONS

Frick, et al., Petroleum Petroleum Handbook, vol. II, Reservoir Engineering, McGraw–Hill Book Co., N.Y., 1962, pp. 35–21 to 35–23.

Amyx, et al., Petroleum Reservoir Engineering, Physical Properties, McGraw–Hill Book Co., N.Y., 1960, p. 257.

Zakirov, S.N., "Theory and Development of Gas . . . ", Nedra (1989), pp. 320–321 (and English translation).

Mirzandzhandze, A. kh., et al., "Exploitation of Gas Condensate . . . ", Nedra (1987), p. 319 (and Engl. trans.).

Mirzandshandze, a. kh., et al., "Technology of Natural Gas Production", Nedra (1987), pp. 373–374 (and Eng. trans.).

*Primary Examiner*—William P. Neuder

*Attorney, Agent, or Firm*—Michael N. Meller

[57] ABSTRACT

A method of producing hydrocarbons from subterranean formations comprises an influence on a hydrocarbon containing bed (1) and extraction of hydrocarbons therefrom through a well (2). The influence on the hydrocarbon containing bed (1) is exerted by means of acting on an aquiferous bed (3) underlying the carbon containing bed (1) by elastic vibrations.

16 Claims, 4 Drawing Sheets

METHOD OF PRODUCING HYDROCARBONS FROM SUBTERRANEAN FORMATIONS

This application is a continuation of PCT/RU94/00136 filed Jun. 24, 1994.

FIELD OF THE INVENTION

The present invention relates to oil and gas production, particularly, to methods for producing oil, gas condensate, gas, and can be utilized at different stages of deposit exploitation.

BACKGROUND OF THE INVENTION

Presently, to the art are known various methods of hydrocarbon production which include an exposure of a hydrocarbon containing bed to some influence or other.

Known in the art is a method of oil production, comprising an influence on a hydrocarbon containing bed and extraction of hydrocarbons therefrom through a well (U.S. Pat. No. 4,417,621).

According to said method the influence is exerted by means of an injection of a gaseous fluid, such as carbon dioxide, to a hydrocarbon containing bed and exposure of the hydrocarbon containing bed to the action of elastic vibrations which increases the carbon dioxide flow and improves oil production efficiency. However, said method requires to inject substantial volumes of gas and, furthermore, a direct action of elastic vibrations on a hydrocarbon containing bed leads to degassing of oil which results in a need to inject an extra volume of carbon dioxide into the hydrocarbon containing bed.

The prior art shows a method of exploiting a flooded oil deposit, comprising an influence on a hydrocarbon containing bed and extraction of hydrocarbons therefrom through a well (SU,A,1596081).

In this method the influence is exerted by means of elastic vibrations from a vibration seismic source which increases oil production only from highly flooded deposits owing to a coagulation of oil dissipated through the flooded hydrocarbon containing bed, and, thus, to a recovery of its mobility.

Said method, however, is inefficient at exploiting an oil deposit having a low flooding factor inasmuch as in this case there occurs an accelerated motion of water, rather than oil, to a well, which results in an increased volume of water extracted from the wells, the oil extraction being reduced.

To the art is known a method of gas condensate production, comprising an additional influence on a hydrocarbon containing bed and extraction of hydrocarbons therefrom through a well (S. N. Zakirov "Theory and Designing of Exploitation of Gas and Gas Condensate Deposits", 1989, Nedra, Moscow). According to said method the additional influence is exerted by means of repumping gas into a hydrocarbon containing bed, maintaining thereby a bed pressure, which prevents a precipitation of a portion of hydrocarbons to a liquid phase and their losses. However, a necessity to inject dried gas into a hydrocarbon containing bed results in a long conservation of gas resources which increases maintenance costs.

Also, known in the art is a method of exploiting a gas, gas condensate or oil deposit, including an influence on a hydrocarbon containing bed and extraction of hydrocarbons therefrom through a well (A. Kh. Mirzandzhandze, I. M. Ametov, K. S. Basniev et al. "Technology of Natural Gas Production", 1987, Nedra, Moscow).

According to said method, the influence on hydrocarbon containing bed is exerted by means of injecting water into it, which displaces a hydrocarbon fluid toward a well. In this method, substantial volumes of water should be injected into a hydrocarbon containing bed through injection wells which entails extra maintenance expenditures for exploiting a deposit, and also losses in a case when entrapped gas and oil are flooded and, as a result, retained in the bed, unextracted hydrocarbons may amount from 15 to 40 percent. Due to large volumes of entrapped gas, said method is not generally used for exploitation of gas and gas condensate deposits.

To the art is known a method of producing hydrocarbons from subterranean formations, comprising an influence on a hydrocarbon containing bed and extraction of hydrocarbons therefrom through a well (A. Kh. Mirzandzhandze, A. G. Durmishyan, A. G. Kovalev, T. A. Allakhverdiev "Exploitation of Gas Condensate Deposits", Nedra, Moscow).

According to said method, a constant gradient pressure is created between gas and oil zones of hydrocarbon containing bed due to forming a gas margin, which provides a displacement and transport of oil by gas and extraction of oil from a well. Said method, however, requires a forced and, generally, prolonged conservation of industrial resources of gas in the hydrocarbon containing bed. At the same time, if gas contains a condensate, retrograde losses of condensate occur before the beginning of the gas condensate region exploitation. In a case the stratum waters possess insufficient activity and head, the gas condensate losses increase.

SUMMARY OF THE INVENTION

The object of the present invention is to provide a method of producing hydrocarbons from subterranean formations, wherein a hydrocarbon containing bed is influenced in order to increase extracted hydrocarbon resources, to simplify the method due to a reduction or elimination of injecting fluids into a hydrocarbon containing bed and conservation thereof, and also to reduce the time of hydrocarbons extraction and thus to improve efficiency of deposit exploitation at different stages.

Said object is attained by a method of producing hydrocarbons from subterranean formations, including an influence on a hydrocarbon containing bed and extraction of hydrocarbons therefrom through a well, wherein according to the present invention, the influence on the hydrocarbon containing bed is exerted by acting on an aquiferous bed underlying said hydrocarbon containing bed by elastic vibrations.

According to one of the embodiments of the invention, it is advantageous to form a gas margin between the hydrocarbon containing bed and aquiferous bed when acting on the aquiferous bed by elastic vibrations.

Also, according to a further embodiment of the present invention the influence by elastic vibrations is exerted a place of contact.

In the next embodiment of the present invention, the influence by elastic vibrations is exerted at a resonance with said gas margin.

In addition to the aforementioned embodiments of the present invention, there are proposed variants wherein

- a fluid is introduced into a carbon containing bed;
- a hydrocarbon containing bed is exposed to heat;
- a hydrocarbon containing bed is influenced by elastic vibrations directly in a region of its bedding.

Also, according to the present invention elastic vibrations form a combustion zone by affecting dynamic characteristics of thermal, gas and liquid flows and thereby the combustion conditions.

Owing to the action of elastic vibrations on an aquiferous bed underlying the hydrocarbon containing bed, the present invention provides a technical result inasmuch as said influence modifies processes affecting the hydrocarbon containing bed condition.

The aforementioned advantages and peculiarities of the present invention will become more obvious from the following description of the preferred embodiment of implementing the invention with references to the drawings attached.

DESCRIPTION OF THE PREFERRED EMBODIMENT OF THE INVENTION

Figure 1:
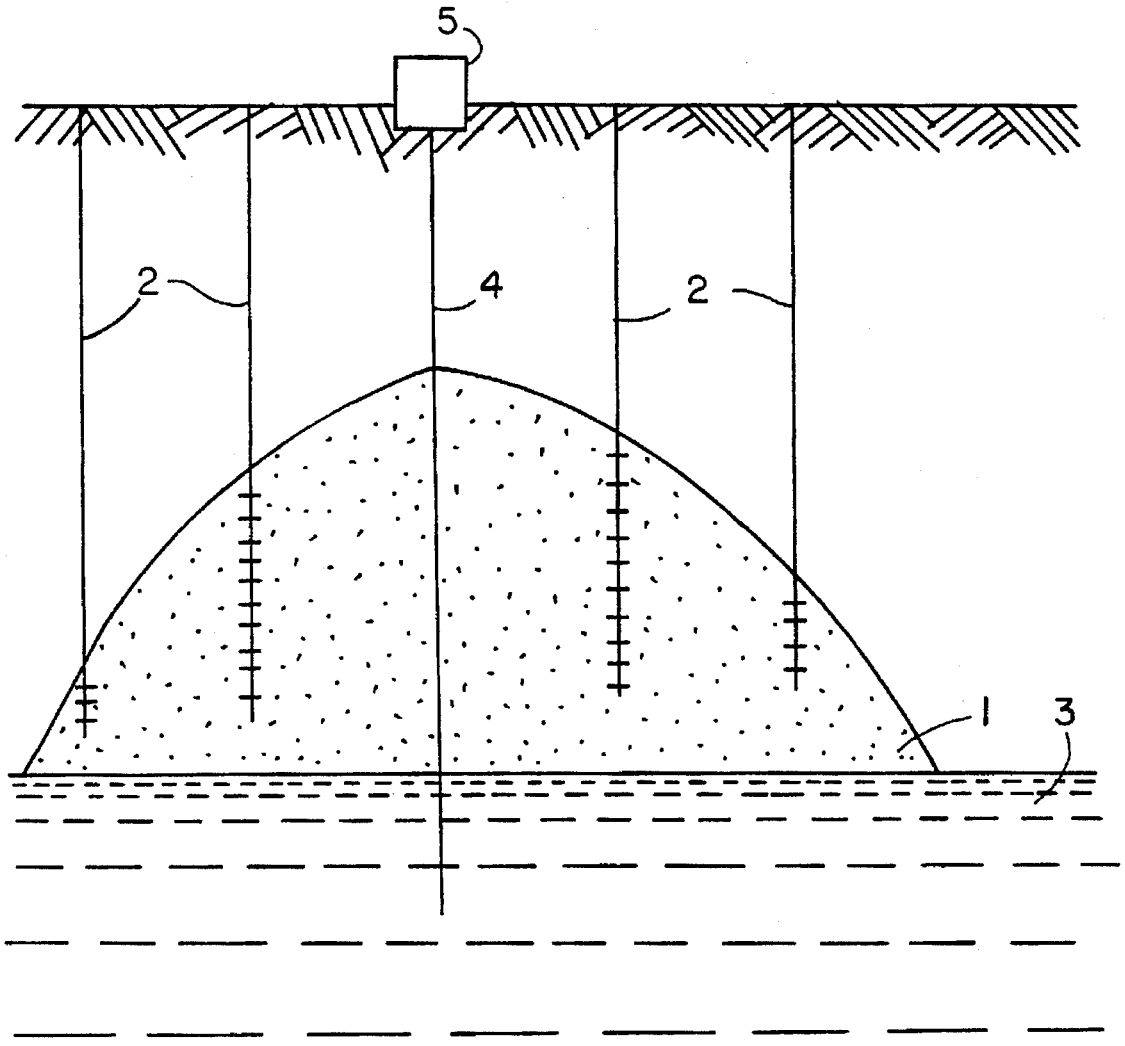
FIG. 1 is a schematic representation of implementing the present method.

As shown in FIG. 1, wells 2 are drilled to a hydrocarbon containing bed 1, or the use can be made of previously formed wells 2 in a depleted deposit containing residual oil, gas condensate or gas. An influence on the hydrocarbon containing bed 1 is exerted by means of acting on an aquiferous bed 3 by elastic vibrations, for which purpose are used, for example, a waveguide 4 and a pulse shock source 6 arranged on the earth surface above the hydrocarbon containing bed 1 and connected to the waveguide 4.

The influence on the hydrocarbon containing bed 1 can be exerted using various physical processes, depending on the extent of gas saturation of waters in the aquiferous bed 3.

The laboratory tests of elastic vibration effect on the flows through capillaries and porous media have demonstrated that within the frequency range from 0.1 to 2000 Hz, in liquids having different viscosity and compressibility, a liquid level in a capillary was raised by $10^3$ and more times as compared to a level provided by capillary forces alone. A direction of liquid flow through a capillary, the flow velocity and height of liquid level rise selectively depend on a frequency of vibrations, capillary diameter, distance between the elastic vibration source and a capillary base.

When acting by the elastic vibrations on gassed liquids there starts an active process of their degassing accompanied by a rapid gas and liquid filtration through porous media.

Thus, under direct influence on a hydrocarbon containing bed 1 by elastic vibrations, fluids are released primarily due to a stimulation and intensification of gas release processes and due to acoustic capillary effects. At the same time, degassing of oil entails a necessity to increase a volume of gas being injected, for example, as it is disclosed in U.S. Pat. No. 4,417,621. Coagulation of liquid dispersed hydrocarbons due to acting on them by elastic vibrations is less efficient and can be used only at highly flooded deposits as it is disclosed in SU, A, 1596081.

According to the present invention, the extracted resources of hydrocarbons can be increased by acting on the aquiferous bed 3 by elastic vibrations, rather than by directly influencing the hydrocarbon containing bed 1 with elastic vibrations, and by modifying a mechanism of influencing the hydrocarbon containing bed 1.

The aquiferous bed 3 is subjected to the influence of elastic vibrations so as to enforce a gas release therefrom. In the aquiferous bed 3, gas can be in a form of dispersed bubbles, in a soluted form and, probably, in a gas hydrate form. Gas release causes a pressure rise in the hydrocarbon containing bed 1, and increases gas content. When degassing the aquiferous bed 3, gas bubbles, streams and retained gas move to the overlying hydrocarbon containing bed 1, such as oil and/or gas condensate bearing bed, providing a displacement of oil and/or gas condensate from the pores of a production bed and their transport to the wells 2. Frequently, waters, directly ajoining natural gas, gas condensate or oil deposits, are extremely gas saturated. In this case, the exposure of the aquiferous bed 3 to the action of elastic vibrations results in a violent gas release therefrom, and further gassing of the overlying bed oil with gas releasing from the aquiferous bed 3 reduces oil viscosity and improves its mobility.

Also, water can move to the hydrocarbon containing bed 1, which further promotes the hydrocarbon displacement and maintenance of a constant bed pressure. Such a flooding can be, for example, advantageously used in the aquiferous bed 3 having low gas factors. This "factor" is defined as gas saturation in reservoir connate water, indicated by "$S_g$ as noted in the prior art reference of Frick, et al, Petroleum Handbook, Vol. II, Reservoir Engineering, McGraw-Hill Book Co., N.Y. 1962, pp. 35–21.

Therefore, the present method can be generally implemented both at depleted deposits having low hydrocarbon content and at deposits having high hydrocarbon content, at the initial stage of exploitation. In the latter case, the present method is of special importance for high/viscosity oil deposits and for gas condensate deposits which are exploited with maintaining a bed pressure.

In addition, the method according to the present invention can be recommended for deposits wherein the retrograde losses of condensate have already occurred and pressure has been reduced, since the gas release from the aquiferous bed 3 and gas movement out of water provides both a displacement of liquid hydrocarbons, precipitated from gas, out of a porous medium, and a pressure increase in the hydrocarbon containing bed 1.

Several examples of implementing the present method are described below.

EXAMPLE 1

As shown in FIG. 1, the aquiferous bed 3 is subjected to the action of elastic vibrations transmitted through a waveguide 4 from a pulse vibration source 5.

The end of the waveguide 4 in the aquiferous bed 3 can be formed as a concentrator. The aquiferous bed 3 is influenced by elastic vibrations, the pulse frequency being varied, for example, from 1 to 45 pulses per a minute and from 45 to 1 pulse per a minute, providing a gas release. A smooth variation of a frequency of pulse succession is alternated with packages of 5–25 preferably rectilinear pulses of various duration and amplitude, which further provides a gas release. The tests have demonstrated that the content of three components of water-soluted gases in the aquiferous bed being as follows: 64% of $CO_2$, 32% of $CH_4$, 4% of $N_2$, said influence causes a release of gas, mainly $CO_2$. This gas, entering the hydrocarbon containing bed 1, such as an oil bearing bed, displaces oil to the wells 2.

EXAMPLE 2

Figure 2:
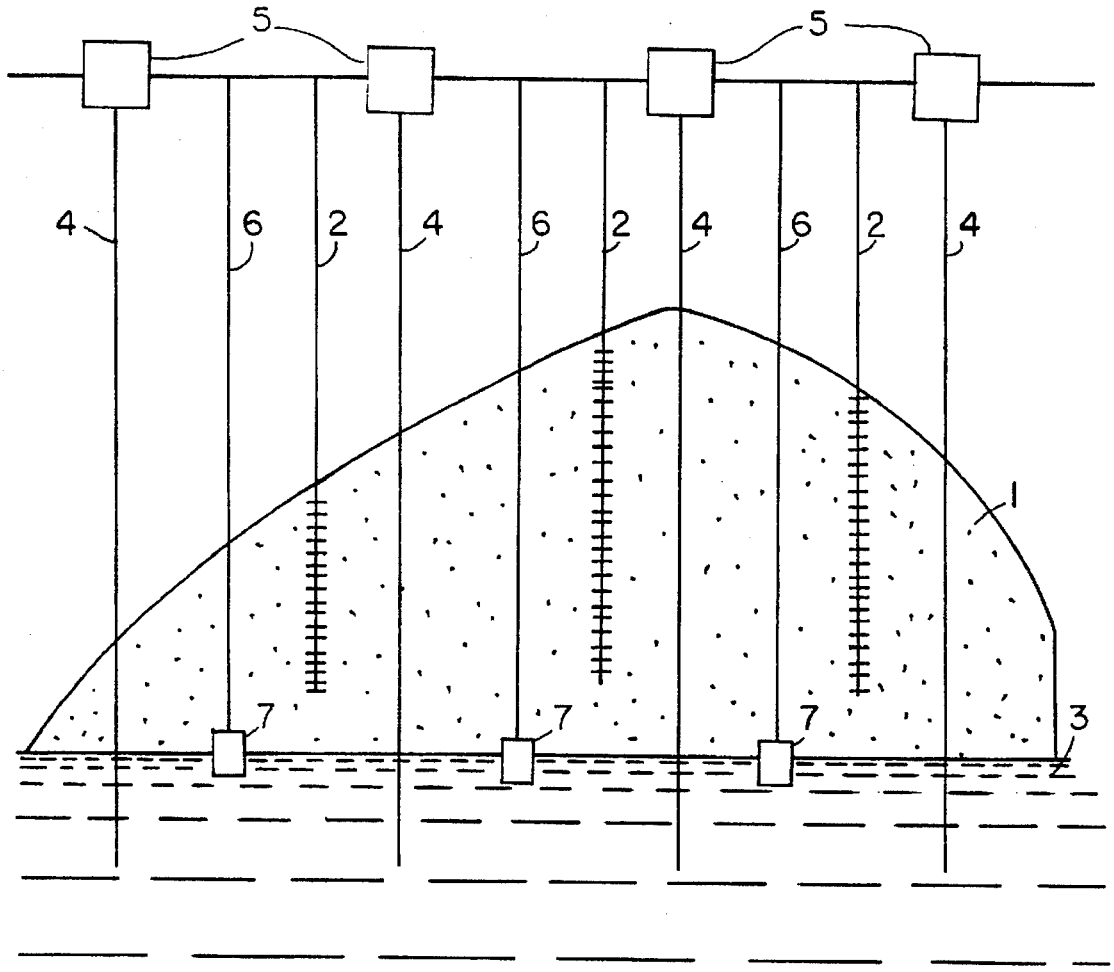
FIG. 2 is the same as FIG. 1, but supplemented with elastic vibration sources arranged at a gas-water or oil-water contact region.

In the aquiferous bed 3 having a low gas factor, harmonic oscillation sources 7 can be lowered into the wells 6, as depicted in FIG. 2. When influencing the hydrocarbon containing bed 1, such as oil bearing bed, through the exposure of the aquiferous bed 3 to the action of elastic vibrations from sources 5 and 7, owing to acoustic capillary and other effects, water moves from the aquiferous bed 3, displacing oil to the wells 2. Sources 7 promote a gas release from the aquiferous bed 3 and this gas causes more intensive water movement into the hydrocarbon containing bed 1 and increases oil mobility. This effect is further promoted due to an excitement of elastic waves in a contact region between the aquiferous bed 3 and the hydrocarbon containing bed 1 and/or from said contact region, the elastic vibrations preventing formation of entrapped oil barriers and also improves a mobility of the actuator contact. As the contact region between the aquiferous bed 3 and the hydrocarbon containing bed 1 rises, the positions of harmonic oscillation sources 7 are adjusted so as they stay in said contact region.

EXAMPLE 3

In the aquiferous bed 3 having a high gas factor, when the hydrocarbon containing bed 1 (FIG. 2) is, for example, a gas condensate bed, the exposure of the aquiferous bed 3 to the action of elastic vibrations from sources 5 and 7 results in a gas release from the bed 3. This gas moves into the hydrocarbon containing bed 1, raising a pressure therein. Gas extraction through the wells 2 is controlled and synchronized with the influence from the sources 5 and 7, while the pressure in the hydrocarbon containing bed 1 is being kept at a level higher than that of a pressure at the beginning of the gas condensation process. This prevents precipitation of a condensate in the hydrocarbon containing bed 1 and ensures a more complete extraction thereof. Additionally, gas and condensate resources are increased owing to supplementing the hydrocarbon containing bed 1 with gas from the aquiferous bed 3.

Along with the gas being released, into the hydrocarbon containing bed 1 may enter water from the aquiferous bed 3 which effect, apart from the transport With the gas bubbles, is stimulated due to acoustic capillary effects and acceleration of a capillary/porous medium impregnation in a field of elastic waves. Also, it causes a pressure increase in the hydrocarbon containing bed 1 and a displacement of gas to the wells 2. In this case, owing to gas mobility exceeding that of the water and to additional gas filtration through the displacement front, no entrapped gas barriers are formed in the field of elastic waves. The source 7 can be also moved along the well in accordance with variation of a position of the contact region between the aquiferous bed 3 and hydrocarbon containing bed 1.

EXAMPLE 4

A source 5 of pulse (for example, shock) vibrations, provided with a waveguide 4 terminating in the aquiferous bed 3, is arranged above a hydrocarbon containing bed 1 (FIG. 3), such as a high-viscosity oil deposit having clay barriers 8. Harmonic oscillation sources 7 are positioned in wells 6 drilled to the aquiferous bed 3. Under the influence of elastic vibrations, gas is released from the aquiferous bed 3 and accumulated in a trap between the aquiferous bed 3 and hydrocarbon containing bed 1, providing a formation of a gas margin 9 partially screened by a clay barrier 8. Further, the exploitation is carried out using a gas "cap" according to the aforementioned prior art of A. Kh. Mirzadzhanzade et al. "Exploitation of Gas Condensate Deposits", Nedra, Moscow. Constant pressure gradients are formed in the hydrocarbon containing bed 1 between the gas margin 9 and the hydrocarbon containing bed 1, providing a displacement and transport of hydrocarbon fluid with gas and extraction of said fluid through the wells 2.

According to the present method, owing to a formation of a gas margin 9 between the hydrocarbon containing bed 1 and aquiferous bed 3, the gas release and motion can occur without the additional pressure gradient, and in majority of cases there is no need to reduce pressure in the hydrocarbon containing bed 1. The gas margin 9 is being continuously filled in with gas from the aquiferous bed 3.

Figure 3:
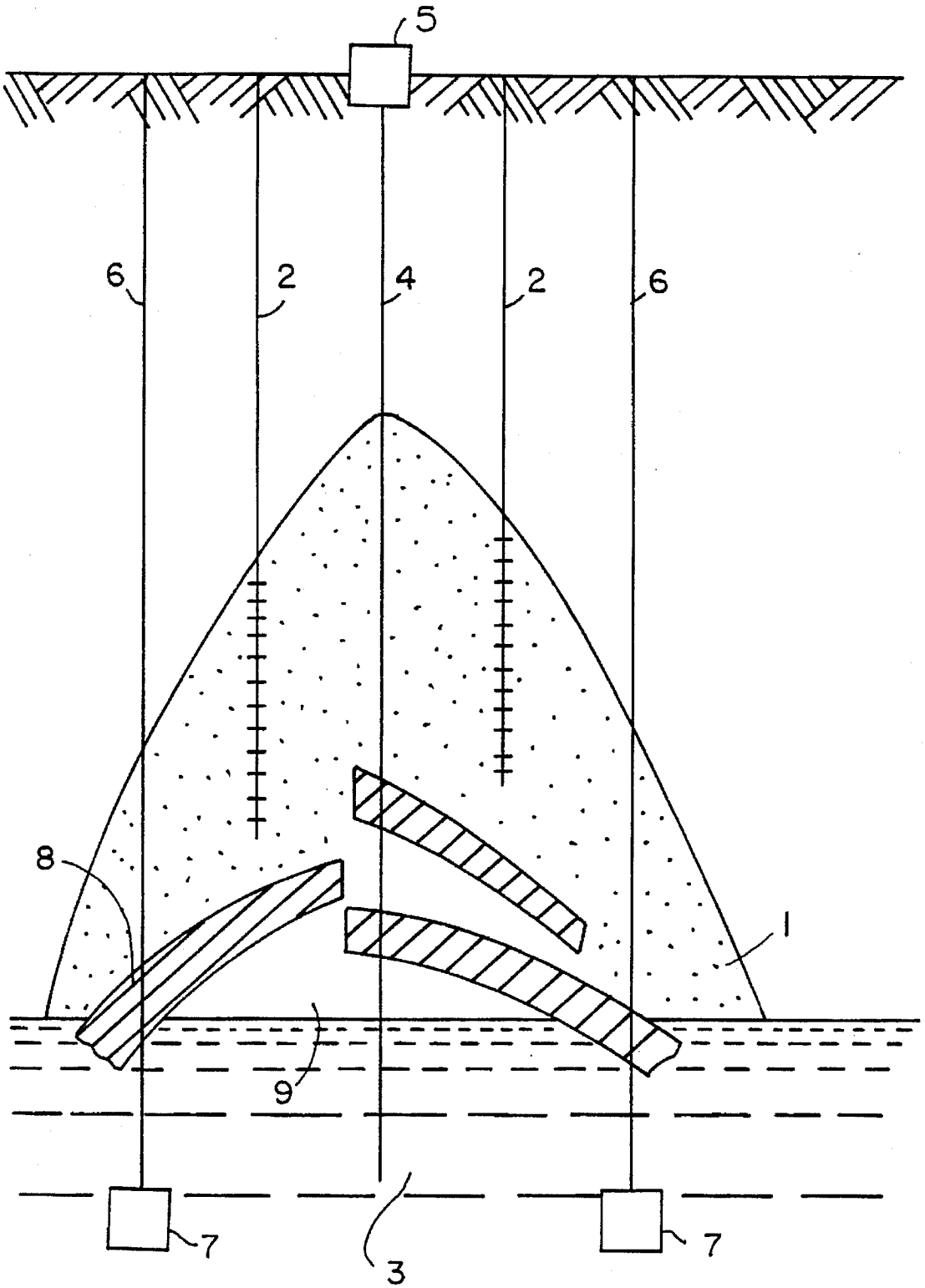
FIG. 3 is the same as FIG. 1, but comprising a gas margin.

The gas margin 9 is formed, for example, by means of reducing pressure at least in a part of the aquiferous bed 3 due to a removal of water through the wells (not shown in FIG. 3) drilled to the aquiferous bed 3. The pressure is reduced to a level not lower than that of the hydrocarbon containing bed 1 pressure. It should be noted that a need to reduce pressure in the aquiferous bed appears at high formation pressures. In most cases, to degas the aquiferous bed it is sufficient to treat it by elastic waves. The most preferable position for forming gas margins 9, as shown in FIG. 3, is a region between the aquiferous bed 3 and low permeable collectors having a clay barrier 9, when high-viscosity oil is present in the deposit.

Having defined a resonance frequency of a gas margin 9, the influence by elastic vibrations can be exerted at a resonance with the gas margin 9 which promotes even more intensive inflow of gas bubbles to the gas margin 9, and the hydrocarbon containing bed 1 is exploited more efficiently due to extending of the gas margin 9 during pulsation thereof. Thus, the release of a hydrocarbon containing fluid in a form of high-viscosity oil is increased.

EXAMPLE 5

Figure 4:
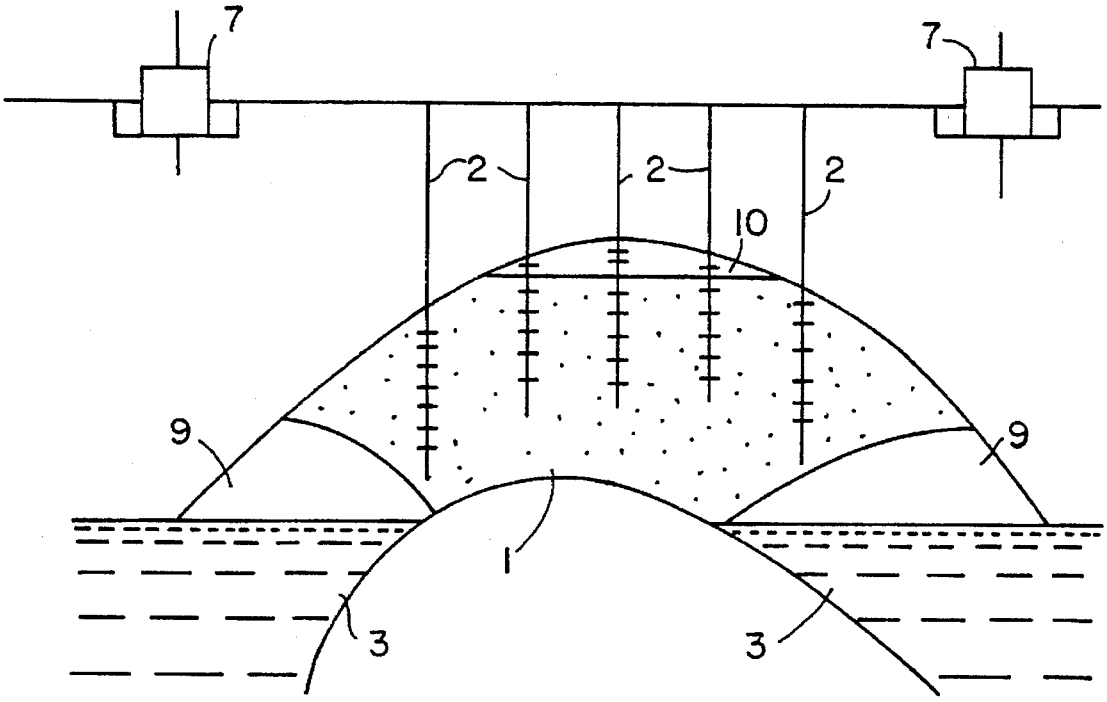
FIG. 4 is a schematic representation of implementing the present method when a contour aquiferous bed is present.

Harmonic oscillation sources 7 are buried into earth above a hydrocarbon containing bed 1 (FIG. 4), such as a high-viscosity oil deposit, along the contour of the underlying aquiferous bed 3. In this case, elastic vibrations act on contour waters of the bed 3.

Figure 5:
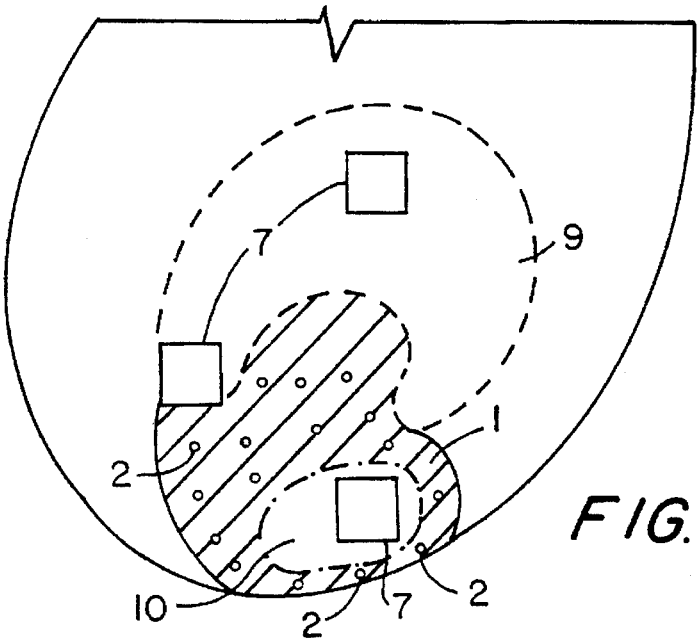
FIG. 5 is a plan view of the earth surface in accordance with FIG. 4.

In FIG. 5, the contour of the hydrocarbon containing bed 1 is shaded.

A deposit can be exploited using several gas "caps", for example, a natural gas cap 10 and one or more artificially formed gas margins 9.

To form gas margins 9, the aquiferous bed 3 is exposed to the action of the sources 7 and degassed. Next, resonance frequencies of gas margins 9 and natural gas cap 10 are defined in the process of the geophysical tests. Further, the influence by elastic vibrations is being continued at a resonance with the gas margin or margins 9, and, similarly, the natural gas cap 10 is influenced at a resonance.

The influence on the gas margins 9 and natural gas cap 10 can be exerted simultaneously and asynchronously, at combined sequences, to provide more complete release of the hydrocarbon fluid and to reduce time of its extraction through the wells 2. Such influence can be also exerted by sources 5 having waveguides 4 (not shown in FIG. 4,5) and by sources 7 as it was described in the previous examples, and the exposure to the action of the elastic vibrations can be effected into a contact region between the aquiferous bed 3 and hydrocarbon containing bed 1 and/or from said region.

As shown in the Examples above, the method according to the present invention is generally efficient at various deposits. When subjecting an underlying aquiferous bed to the action of elastic vibrations, said bed acts on the hydrocarbon containing bed 1 like a piston, increasing thereby the hydrocarbon resources being extracted and reducing time of the extraction. Such a comparison is the most appropriate representation of a mechanism of hydrocarbon extraction when the gas margin 9 is formed between the aquiferous bed 3 and hydrocarbon containing bed 1.

The method of the present invention can be combined with other methods for production hydrocarbons from subterranean formations.

The process of exploiting an oil deposit, comprising an exposure of the aquiferous bed 3 to the action of elastic vibrations, can be further combined with injection of a fluid. For example, when the hydrocarbon containing bed 1 has low gas factors, a gas, such as $CO_2$, air, etc., can be additionally injected into it. However, said fluid injection is of a substantially lower volume and of less duration. It is also possible to inject other fluids, such as a wide fraction of light hydrocarbons. It is used in a process of oil displacement by miscible phase. Gas released from an aquiferous bed enriches the wide fraction of light hydrocarbons. Combinations of displacement, for example, of gas condensate formed in the formation, by released gas, wide fraction of light hydrocarbons, gas-enriched wide fraction of light hydrocarbons, results in a more complete recovery of hydrocarbons from the formation.

When producing high-viscosity oil, in order to further reduce the oil viscosity, the hydrocarbon containing bed can be exposed to heat along with acting on the aquiferous bed 3 by elastic vibrations for degassing thereof, forming a gas margin, etc. Such heat exposure can be implemented by means of an in-bed combustion. The elastic waves influence the burning flame due to intensification of heat and mass exchange in the field of elastic waves. Variation of this influence changes the combustion zone shape, increases temperature gradients and heat transfer from the combustion zone to heat-absorbing surfaces, modifies a combustion velocity and flame dimension. Reduction of the flame length by the elastic vibration treatment can accelerate a burn up in the zone and increase temperature therein. Also, a diffusion on an oxidant into the combustion zone is accelerated, intensifying the process of its mixing. Also, the elastic waves form a combustion zone.

Moreover, the hydrocarbon containing bed 1 can be additionally affected by a vibration source 5 directly from the earth surface, which accelerates motion of gas bubbles and oil in the hydrocarbon containing bed 1, and partial degassing of oil can be compensated by additional supply of gas from the aquiferous bed 3.

Advantages of the method according to the present invention reside in the fact that said method allows to raise oil, gas condensate and gas production, and to increase resources being extracted. Moreover, deposits recognised as unprofitable, such as deposits with insufficient trap filling, depleted deposits, deposits containing gas condensate precipitated due to a retrograde condensation, and residual oil, flooded gas and oil deposits, can also be also exploited using the method according to the invention. As shown, the present method either does not entirely require to inject the displacing fluids or such injection can be carried out at a considerably reduced extent. This relates both to the water removal applied to reduce a bed pressure, and to degassing of the aquiferous bed 3. The present method allows one either to exclude the water removal or to perform it at a substantially reduced extent and time. The advantages of the method according to the present invention also include a more efficient utilization of oscillation sources and a possibility to minimize probable negative effects of the influence on the bed.

Each gas or oil deposit is linked with a water head system taking part in forming thereof. The method according to the present invention allows to develop said link, to affect a process of deposit forming, to accelerate said process and to form deposits having predetermined parameters, and to recover depleted deposits. Elastic waves from oscillation sources 5 and 7 and acoustic emission effects, accompanying them immediately in the hydrocarbon containing bed 1, stimulate gas release from the aquiferous bed 3 and intensify its motion to the overlying strata.

The thermodynamic conditions of gas vary in the process of its movement and this can cause a phase balance shift and a release of liquid hydrocarbons, providing an increase of oil and gas condensate resources being extracted. Thus, the present method allows not only to displace oil from an oil deposit formed as the result of geological processes, but to further increase gas resources being extracted. The present method essentially replicates the natural seismic mechanism of forming a hydrocarbon deposit, but in contrast to the latter it is Controlled.

The method of the present invention can possess other advantages following from the present description and obvious to a person skilled in the art.

INDUSTRIAL APPLICABILITY

The present method of producing hydrocarbons from subterranean formations can be most successfully utilized for oil and gas production when exploiting deposits having different saturation of a hydrocarbon containing bed.

We claim:

1. A method of recovering hydrocarbons from subterranean formations comprising the steps of:

(a) generating elastic vibrations and directing said elastic vibrations into an aquiferous bed underlying a hydrocarbon-containing formation to degas said aquiferous bed and introduce obtained gas to said hydrocarbon-containing formation from below upwards so that to effect said hydrocarbon-containing formation and displace hydrocarbons therefrom by gas moving upwards;

(b) forming at least one gas cap between said aquiferous bed and said hydrocarbon-containing formation; and (c) lifting said hydrocarbons through a well communicating with said hydrocarbon-containing formation.

2. A method according to claim 1 in which said gas cap is formed by pumping off water from said aquiferous bed.

3. A method according to claim 1 in which gas cap is formed by exposure of said aquiferous bed to elastic vibrations.

4. A method according to claim 1 in which elastic waves are generated at frequencies in resonance with said gas cap.

5. A method according to claim 4 in which elastic waves are generated at frequencies in resonance with said gas cap and in resonance with at least one natural gas cap overlying said hydrocarbon-containing formation.

6. A method according to claim 1 in which said aquiferous bed and hydrocarbon-containing formation are treated by elastic vibrations from a place of contact between said aquiferous bed and hydrocarbon-containing formation by an additional generator of elastic vibrations to increase mobility of said contact.

7. A method according to claim 6 in which said generator of elastic vibrations is lifted as water rises from the aquiferous bed.

8. A method according to claim 1 in which said hydrocarbon-containing formation is exposed to heat.

9. A method according to claim 8 in which said heat exposure is provided by an in-bed combustion, an in-bed combustion source being enhanced by elastic vibrations.

10. A method according to claim 1 in which a fluid is injected into said hydrocarbon-containing formation.

11. A method according to claim 10 in which said fluid comprises a substance capable to dissolve hydrocarbons.

12. A method according to claim 11 in which said substance comprises a wide fraction of light hydrocarbons.

13. A method according to claim 1 in which a constant pressure is maintained in said hydrocarbon-containing formation by gas motion from the underlying aquiferous bed.

14. A method according to claim 9 in which said gas cap is enhanced by exposure of said aquiferous bed to elastic vibrations.

15. A method of recovering hydrocarbons from subterranean formations comprising the steps of:

(a) generating elastic vibrations by a generator from a place of contact with an aquiferous bed underlying a hydrocarbon-containing formation, to degas said aquiferous bed and introduce water and obtained gas into said hydrocarbon-containing formation from below upwards so that to effect said hydrocarbon-containing formation and displace hydrocarbons therefrom by gas and water moving upwards; and (b) lifting said hydrocarbons through a well communicating with said hydrocarbon-containing formation, wherein, between said aquiferous bed and said hydrocarbon-containing formation at least one gap is formed by pumping water from said aquiferous bed, and wherein elastic waves are generated at frequencies in resonance with said gas cap and in resonance with at least one natural gas cap overlying said hydrocarbon-containing formation.

16. A method according to claim 5 in which said generator of elastic vibrations is lifted as water rises from the underlying aquiferous bed.

* * * * *